US009509047B2

(12) United States Patent
Tay et al.

(10) Patent No.: US 9,509,047 B2
(45) Date of Patent: Nov. 29, 2016

(54) SELF-CONFIGURABLE RESONANCE ANTENNA

(71) Applicants: Roger Tay, Singapore (SG); Ng Guan Hong, Singapore (SG); Bong Jun San, Singapore (SG); Tan Yew Choon, Singapore (SG); Chan Yun Ghit, Singapore (SG); Karen Goh Hui Leng, Singapore (SG)

(72) Inventors: Roger Tay, Singapore (SG); Ng Guan Hong, Singapore (SG); Bong Jun San, Singapore (SG); Tan Yew Choon, Singapore (SG); Chan Yun Ghit, Singapore (SG); Karen Goh Hui Leng, Singapore (SG)

(73) Assignee: AAC Technologies Pte. Ltd, Singapore (SG)

( * ) Notice: Subject to any disclaimer, the term of this patent is extended or adjusted under 35 U.S.C. 154(b) by 60 days.

(21) Appl. No.: 14/524,071

(22) Filed: Oct. 27, 2014

(65) Prior Publication Data

US 2015/0116183 A1 Apr. 30, 2015

(30) Foreign Application Priority Data

Oct. 28, 2013 (CN) ..... 2013 1 0518179

(51) Int. Cl.

| | |
|---|---|
| ***H01Q 1/50*** | (2006.01) |
| ***H01Q 5/328*** | (2015.01) |
| ***H01Q 1/24*** | (2006.01) |
| ***H01Q 9/42*** | (2006.01) |
| ***H01Q 5/378*** | (2015.01) |

(52) U.S. Cl.

CPC ..... *H01Q 5/328* (2015.01); *H01Q 1/243* (2013.01); *H01Q 5/378* (2015.01); *H01Q 9/42* (2013.01)

(58) Field of Classification Search

CPC ..... H01Q 5/328; H01Q 9/42; H01Q 1/243; H01Q 5/378

See application file for complete search history.

(56) References Cited

U.S. PATENT DOCUMENTS

| | | | | |
|---|---|---|---|---|
| 2011/0012793 | A1* | 1/2011 | Amm | H01Q 1/243 343/702 |
| 2011/0012800 | A1* | 1/2011 | Shamblin | H01Q 1/243 343/746 |
| 2013/0099996 | A1* | 4/2013 | Tseng | H01Q 9/42 343/876 |

* cited by examiner

*Primary Examiner* — Hoang V Nguyen
*Assistant Examiner* — Michael Bouizza
(74) *Attorney, Agent, or Firm* — Na Xu; IPro, PLLC

(57) ABSTRACT

A self-configurable resonance antenna includes a main antenna for transmitting and receiving radio waves of a plurality of mutually different frequency bands, a coupling element having at least two radiating patches with different effective electrical lengths for configuring the impedance of the self-configurable resonance antenna, and a matching circuit disposed between the main antenna and the coupling element. The matching circuit has a filter, a RF detector, a switching logic and a RF switch, the RF switch switching between at least the two radiating patches with different effective electrical lengths for adjusting the main antenna operating in different frequency bands.

6 Claims, 4 Drawing Sheets

SELF-CONFIGURABLE RESONANCE ANTENNA

RELATED PATENT APPLICATION

This application claims the priority benefit of Chinese Patent Application Filing Serial Number CN 201310518179.5, filed on Oct. 28, 2013, the disclosure of which is herein incorporated by reference in its entirety.

FIELD OF THE INVENTION

The present disclosure generally relates to an antennas for wireless communications devices, and more particularly to a self-configurable resonance antenna for adaptively controlling antenna parameters to improve performance of the communications device.

DESCRIPTION OF RELATED ARTS

With the recent advancements in wireless technology, Long Term Evolution (LTE) has become a dominant wireless communications standard. Smart phones, handheld computers, laptops and even GPS device running on high LTE speeds have made wireless communication easier than before. Since the LTE standard covers a range of many different bands, this has driven a demand for multiband antenna.

It is known that antenna performance is dependent on the size, shape and material composition of the antenna elements, and the relationship between certain antenna physical parameters (e.g., length for a linear antenna and diameter for a loop antenna) and the wavelength of the signal received or transmitted by the antenna. These physical and electrical characteristics determine several antenna operational parameters, including input impedance, gain, directivity, signal polarization, resonant frequency, bandwidth and radiation pattern. Since the antenna is an integral element of a signal receiving and transmitting path of a communications device, antenna performance directly affects device performance.

Generally, an operable antenna should have a minimum physical antenna dimension on the order of a half wavelength of the operating frequency to limit energy dissipated in resistive losses and maximize transmitted or received energy. Due to the effect of a ground plane image, a quarter wavelength antenna (or odd integer multiples thereof) operative above a ground plane exhibits properties similar to a half wavelength antenna. Communications device product designers prefer an efficient antenna that is capable of wide bandwidth and/or multiple frequency band operation, electrically matched to the transmitting and receiving components of the communications system, and operable in multiple modes.

The burgeoning growth of wireless communications devices and systems has created a substantial need for physically smaller, less obtrusive, and more efficient antennas that are capable of wide bandwidth or multiple frequency-band operation, and/or operation in multiple modes (i.e., selectable radiation patterns or selectable signal polarizations). For example, operation in multiple frequency bands may be required for operation of the communications device with multiple communications systems or signal protocols within different frequency bands. And, a cellular telephone system transmitter/receiver and a global positioning system receiver operate in different frequency bands using different signal protocols. Operation of the device in multiple countries also requires multiple frequency band operation since communications frequencies are not commonly assigned in different countries.

Smaller packaging of state-of-the-art communications devices, such as personal communications handsets, does not provide sufficient space for the conventional quarter and half wavelength antenna elements. Physically smaller antennas operable in the frequency bands of interest (i.e., exhibiting multiple resonant frequencies and/or wide bandwidth to cover all operating frequencies of the communications device) and providing the other desired antenna-operating properties (input impedance, radiation pattern, etc.) are especially sought after.

Increased gain thus requires a physically larger antenna, while users continue to demand physically smaller handsets that in turn require smaller antennas. As designers of portable communications devices (e.g., cellular handsets) continue to shrink device size while offering more operating features, the requirements for antenna performance become more stringent. Achieving the next level of performance for such communications devices requires smaller antennas with improved performance, especially with respect to radiation efficiency. Currently, designers struggle to obtain adequate multi-band antenna performance for the multi-band features of the devices. But as is known, efficiency and bandwidth are related and a design trade-off is therefore required. Designers can optimize performance in one (or in some cases more than one) operating frequency band, but usually must compromises the efficiency or bandwidth to achieve adequate performance in two or more bands simultaneously. However, most portable communications devices seldom require operation in more than one band.

Therefore, to overcome the antenna size limitations imposed by handset and personal communications devices, the present disclosure provides a self-configurable resonance antenna to solve the problems mentioned above.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

Reference will now be made to describe the exemplary embodiments of the present disclosure in detail.

Figure 1:
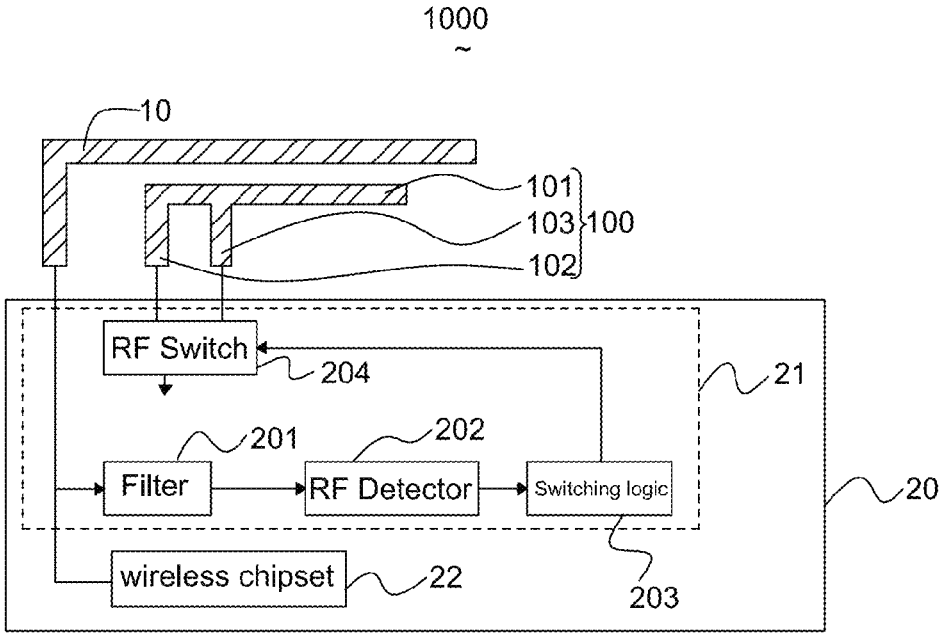
FIG. 1 is a schematic view of a configuration of a self-configurable resonance antenna in accordance with a first embodiment of the present disclosure.

Referring to FIG. 1, a schematic view of a self-configurable resonance antenna used in a handheld (i.e., mobile phones, PDA, panel computers or mobile powers) according to a first exemplary embodiment of the present disclosure is shown. The handheld has a print circuit board 20 acting as a ground plane, a self-configurable resonance antenna 1000 and wireless chipset 22. The self-configurable resonance antenna 1000 will establish a connection with a base station in one frequency band through the wireless chipset 22 when the handheld is powered up. The wireless chipset 22 transmits or receives signals at the frequency band by the self-configurable resonance antenna 1000. The self-configurable resonance antenna 1000 comprises a main antenna 10 capable of operating in different frequency bands, and a coupling element 100 corresponding to the main antenna 10 capable of configuring the impedance of the antenna 10.

In this embodiment, the main antenna 10 is a signal antenna electrically connecting with the wireless chipset 22 and a matching circuit 21. The matching circuit 21 is disposed between the signal antenna and the coupling element 100, and is used to process and select the coupling element 100 so as to extend the effective electrical length of self-configurable resonance antenna 1000 at different degree. Detailed, the coupling antenna 100 is a parasitic element which has a radiating patch 101 and two branch pins 102, 103 extending from the radiating patch 101 along the effective electrical length of the radiating patch 101. That is to say, the two branch pins 102, 103 cooperate with the radiating patch 101 that is equal to at least two radiating patches with different effective electrical length. The two branch pins 102, 103 electrically connect with a matching circuit 21 located on the PCB 20. The matching circuit 21 is capable of measuring RF signals transmitted by the wireless chipset 22 of the handheld and includes a filter 201, a RF detector 202, a switching logic 203 and a RF switch 204 connected to be grounded. The RF signals are received and treated by the filter 201 of the matching circuit 21 so as to eliminate noise of the RF signals. The RF detector 202 samples the RF signals and converts it into DC output that is proportional to the RF power. The switching logic 203 compares the DC output and translates an output which controls the RF switch 204 to be electrically connected with among the branch pins 102, 103 so that the self-configurable resonance antenna 1000 may be operates in the different frequency bands. This is intended to reduce the size of the self-configurable resonance antenna 1000 while allowing usage of the multi-band antenna with a plurality of frequency bands.

That is, for example, upon detecting that the radio communication system to which the handheld belongs uses radio waves of Band 1, the RF switch 204 causes only the branch pin 102 to be in a coupled state to set the self-configurable resonance antenna 1000 to Operation Mode 1. Similarly, upon detecting that the radio communication system to which the handheld belongs uses radio waves of Band 2, causes only the other branch pin 103 to be in a coupled state to set the self-configurable resonance antenna 1000 to Operation Mode 2. The coupling element 100 adjusts the impedance of the main antenna 10 by the RF switch 204 switching between two branch pins 102, 103 so as to control the effective electrical length of the self-configurable resonance antenna 1000. It is noted that setting of operation modes may be performed automatically by automatic detection of the frequency band used in a radio communication system, and may also be performed in accordance with a user's operation. According to the embodiment of the present invention, the self-configurable resonance antenna 1000 is tuned (by controlling its effective electrical length) to a desired resonant frequency to obviate resonance detuning caused by the operating environment of self-configurable resonance antenna.

Figure 2:
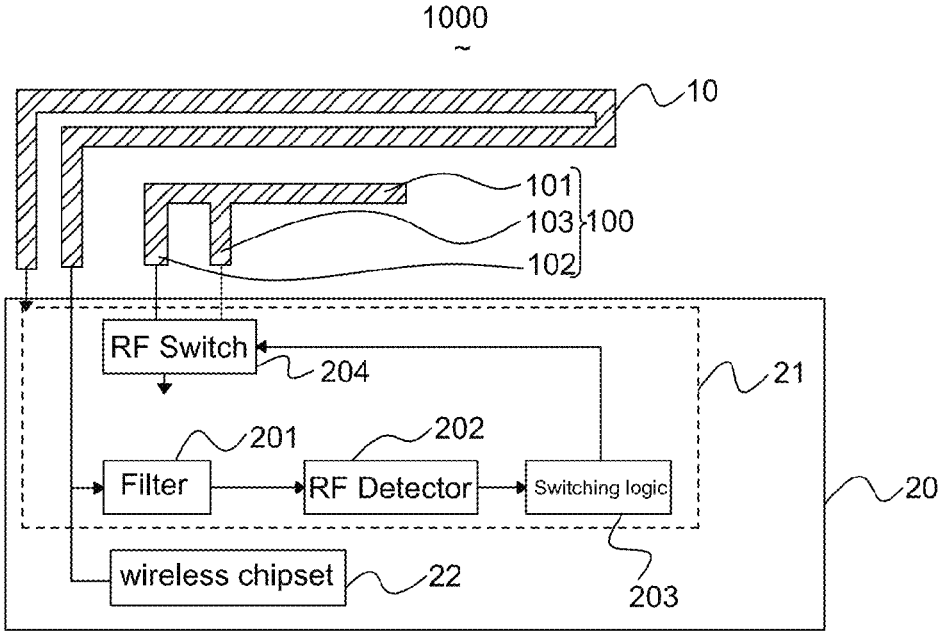
FIG. 2 is a schematic view of a configuration of a self-configurable resonance antenna in accordance with a second exemplary embodiment of the present disclosure.

Referring to FIG. 2, a second embodiment of the present disclosure is shown. In the embodiment, the main antenna 10 is a loop antenna which has one end electrically connecting with the PCB 20 acting as a grounding end, and the other end electrical connecting with the wireless chipset 22 and the filter 201 of the matching circuit 21. FIG. 2 shows other components having the same configurations and functions to the first embodiment.

Figure 3:
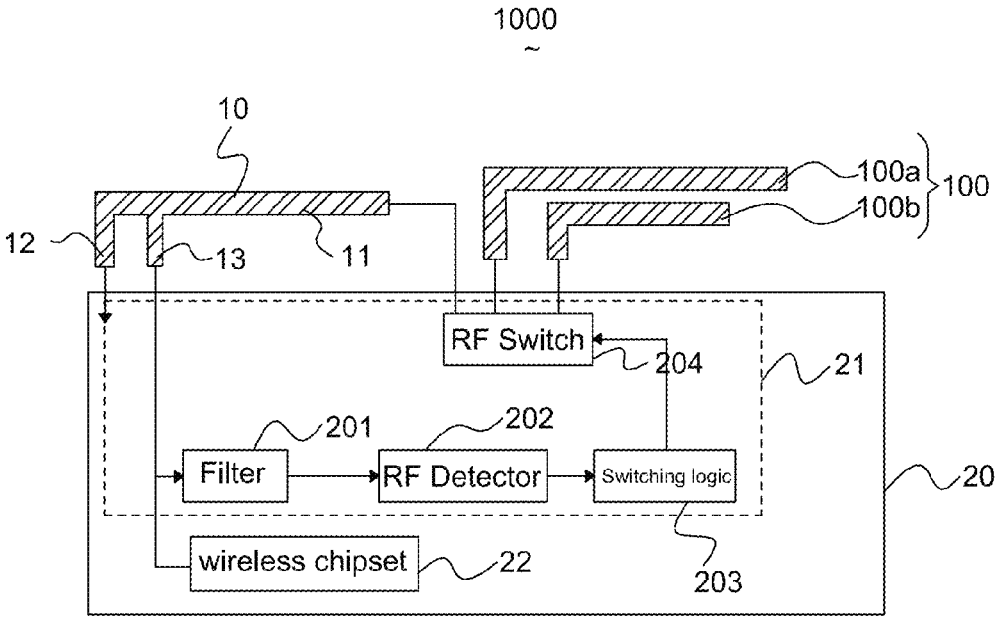
FIG. 3 is a schematic view of a configuration of a self-configurable resonance antenna in accordance with a third exemplary embodiment of the present disclosure.

Referring to FIG. 3, a third embodiment of the present disclosure is shown. The self-configurable resonance antenna 1000 has a main antenna 10 which is a PIFA antenna. The PIFA antenna defines a radiating patch 11 and two branch pins 12, 13 extending from the radiating patch 11 along the effective electrical length of the radiating patch 11. One of the two branch pins 12, 13 is grounded, and the other branch pin 13 electrically connects with a filter 201 of a matching circuit 21. One end of the radiating patch 11 of the PIFA antenna electrically connects with a RF switch 204. In additional, the RF 204 electrical connects with a coupling element including two parasitic elements 100*a*, 100*b* with different effective electrical length. The RF switch 204 may be established a connection with one of the two parasitic elements 100*a*, 100*b* in different operating frequency bands according to the work mode. Other components shown in FIG. 3 but not mentioned such as the matching 21 and the wireless chipset 22 have the same configurations and functions to the first embodiment.

Figure 4:
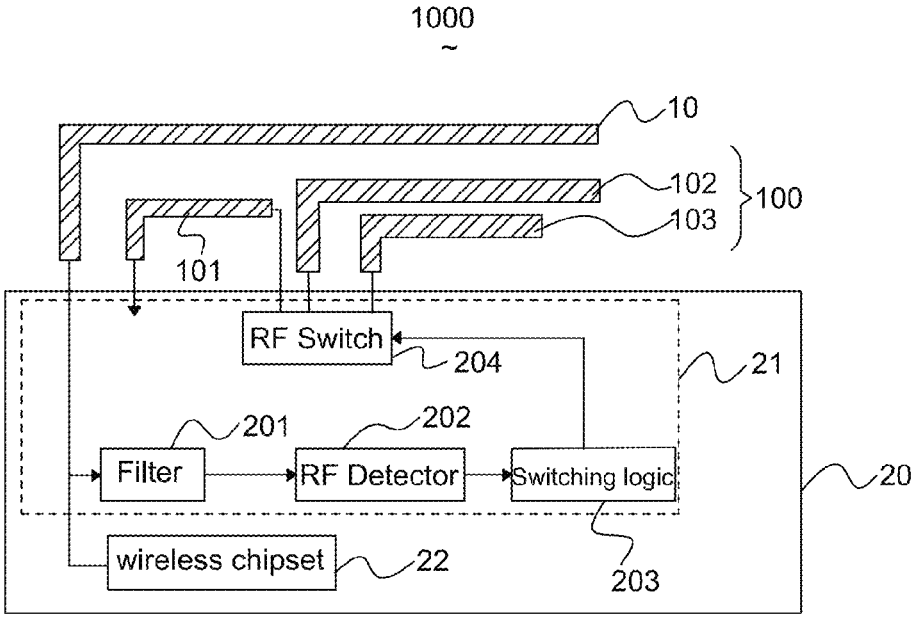
FIG. 4 is a schematic view of a configuration of a self-configurable resonance antenna in accordance with a fourth exemplary embodiment of the present disclosure.

Referring to FIG. 4, a fourth embodiment of the present disclosure is shown. The configuration of the main antenna 10, the coupling element 100 and the matching circuit shown in FIG. 4 are equal to those of the main antenna 10, the coupling element 100 and matching circuit 21 of the third embodiment. Somewhat differently, the main antenna 10 defines a signal antenna 11 and a signal parasitic element 12 grounded. The signal antenna 11 electrically connects with a filter 201 of a matching circuit 21 and the wireless chipset 22. The signal parasitic 12 electrically connects with RF switch 204 of the matching circuit 21.

Figure 5:
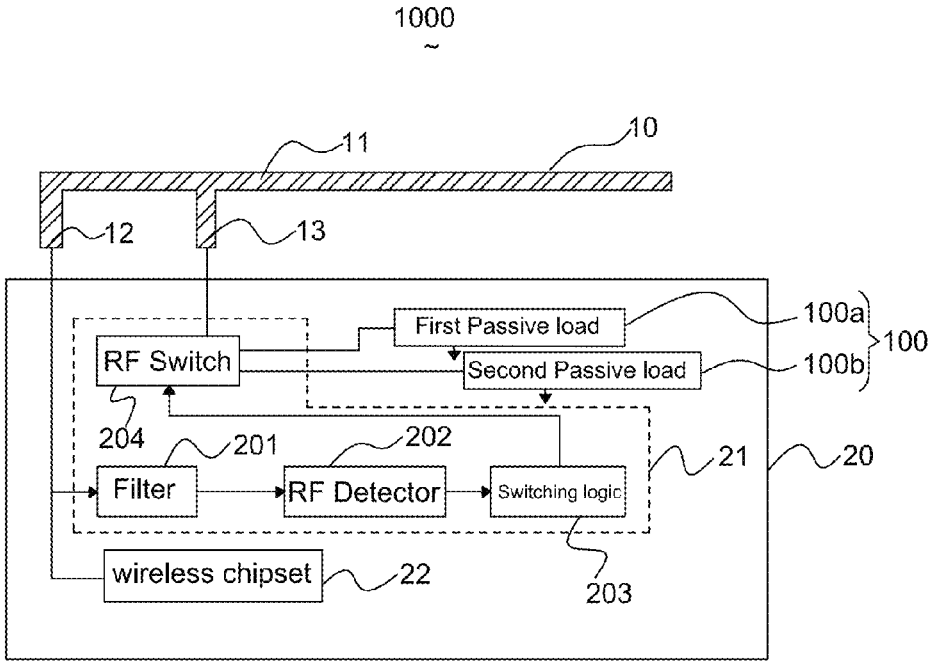
FIG. 5 is a schematic view of a configuration of a self-configurable resonance antenna in accordance with a fifth exemplary embodiment of the present disclosure.

Referring to FIG. 5, which shows a fifth embodiment of the present disclosure, the main antenna 10 is a PIFA antenna which has a radiating patch 11 and two branch pins 12, 13 extending from the radiating patch 101. One branch pin 12 electrically connecting with a filter 201 of a matching circuit 21 and a wireless chipset 22 of the handheld, respectively, and the other branch pin 13 is electrically connecting with a RF switch 204 of the matching circuit 21. In additional, a coupling element 100 electrically connects with the RF switch 204 and has a first passive load 100*a* and a second passive load 100*b* disposed on the PCB 20 connected to be grounded. The RF switch 204 switches between the two different passive loads 100*a*, 100*b* to optimize the impedance of the main antenna 10. In the embodiment, other components but not mentioned have the same configurations and functions to the first embodiment.

Figure 6:
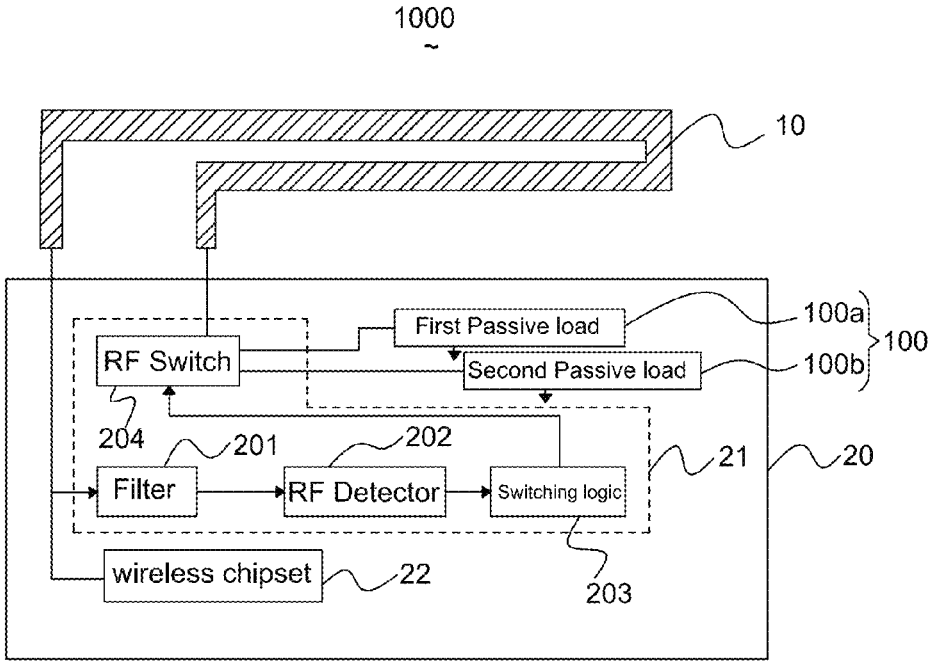
FIG. 6 is a schematic view of a configuration of a self-configurable resonance antenna in accordance with a sixth exemplary embodiment of the present disclosure.

Referring to FIG. 6, a sixth embodiment of the present disclosure is shown. The configuration of the main antenna 10, the coupling element 100 having two passive loads 100*a*, 100*b* and the matching circuit shown in the FIG. 6 are equal to those of the main antenna 10, the coupling element 100 and matching circuit 21 of the fifth embodiment. Somewhat differently, the main antenna 10 is a loop antenna.

Figure 7:
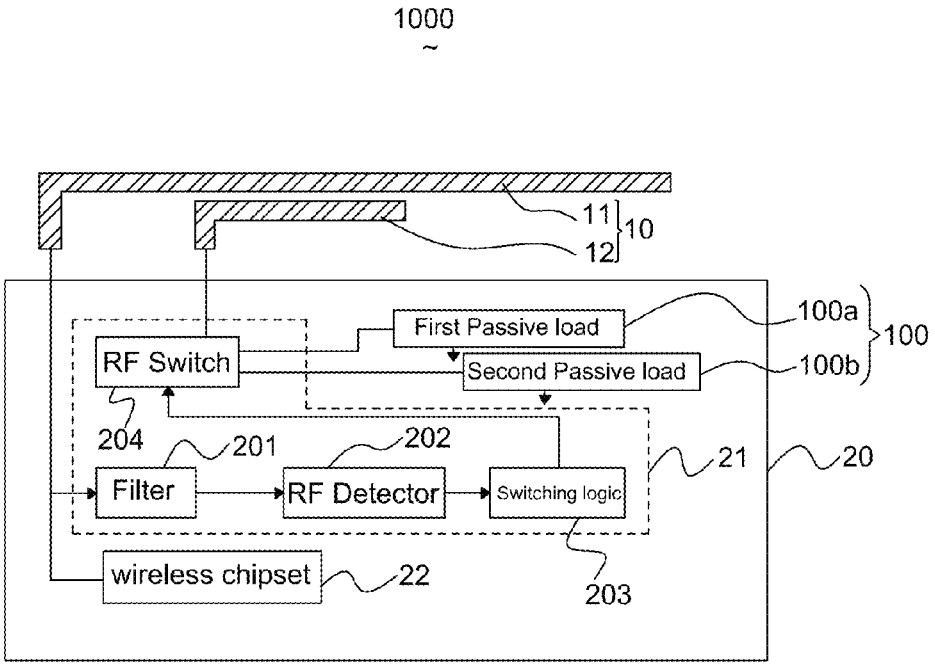
FIG. 7 is a schematic view of a configuration of a self-configurable resonance antenna in accordance with a seventh exemplary embodiment of the present disclosure.

Referring to FIG. 7, a seventh embodiment of the present disclosure is shown. In the embodiment, the main antenna 10 has a signal antenna 11 electrically connecting with a filter 201 of a matching circuit 21 and a wireless chipset 22 of the handheld, respectively, and a signal parasitic element 12 coupling to the signal antenna 11. The signal parasitic element 12 electrically connects with a RF switch 204 of a matching circuit 21. Other components, shown in FIG. 7 but not mentioned, have the same configurations and functions to the fifth embodiment.

Figure 8:
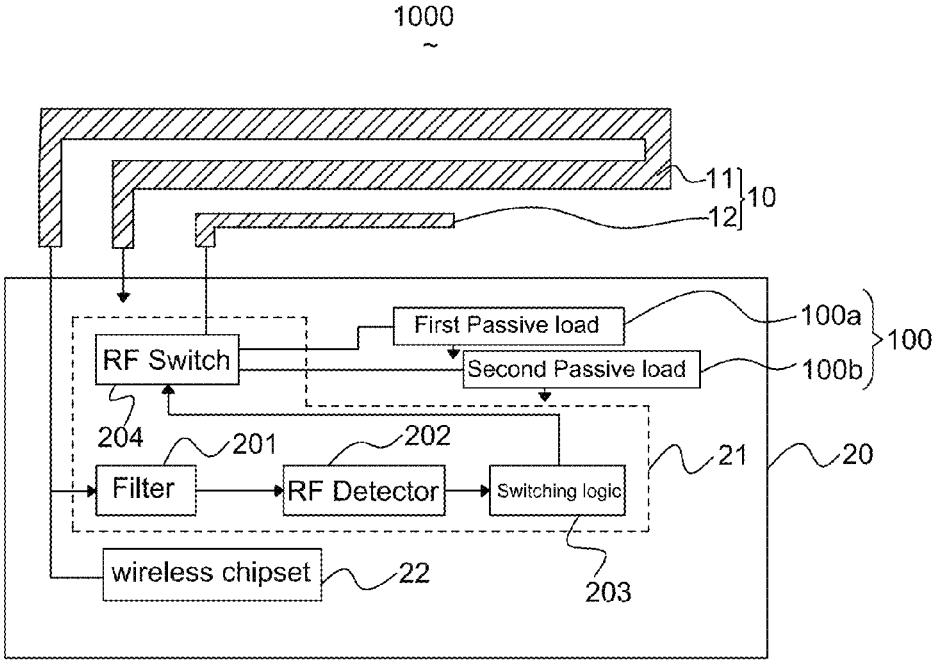
FIG. 8 is a schematic view of a configuration of a self-configurable resonance antenna in accordance with an eighth exemplary embodiment of the present disclosure.

Referring to FIG. 8, an eighth embodiment of the present disclosure is shown. The matching circuit 21, the coupling element 100 and signal parasitic element 12 are much the same as those of the fifth embodiment, but differently, the main antenna 10 defines a signal parasitic element 12 electrically connects with the RF switch 204 of the matching circuit 21, a loop antenna 11 including one end electrically connecting with a filter 201 of a matching circuit 21 and a wireless chipset 22 of the handheld, respectively, and the other end grounded. Other components shown in FIG. 8 but not mentioned have the same configurations and functions to the seventh embodiment.

While the present invention has been described with reference to specific embodiments, the description of the invention is illustrative and is not to be construed as limiting the invention. Various of modifications to the present invention can be made to the exemplary embodiments by those skilled in the art without departing from the true spirit and scope of the invention as defined by the appended claims.

What is claimed is:

1. A self-configurable resonance antenna, comprising:

a main antenna for transmitting and receiving radio waves of a plurality of mutually different frequency bands, the main antenna defining a loop antenna;

a coupling element defining a radiating patch and two branch pins extending from the radiating patch along the effective electrical length of the radiating patch;

a matching circuit disposed between the main antenna and the coupling element, and defining a filter, a RF detector, a switching logic and a RF switch grounded, the RF switch switching between the two branch pins with different effective electrical lengths for adjusting the main antenna operating in different frequency bands.

2. A self-configurable resonance antenna, comprising:

a main antenna for transmitting and receiving radio waves of a plurality of mutually different frequency bands, the main antenna defining a signal antenna and a signal parasitic element grounded;

a coupling element having at least two parasitic elements with different effective electrical lengths for configuring the impedance of the self-configurable resonance antenna:

a matching circuit disposed between the main antenna and the coupling element and defining a filter, a RF detector, a switching logic and a RF switch, the RF switch switching between at least the two parasitic elements with different effective electrical lengths for adjusting the main antenna operating in different frequency bands.

3. A self-configurable resonance antenna, comprising:

a main antenna for transmitting and receiving radio waves of a plurality of mutually different frequency bands;

a coupling element having two passive loads for configuring the impedance of the self-configurable resonance antenna;

a matching circuit disposed between the main antenna and the coupling element and defining a filter, a RF detector, a switching logic and a RF switch, the RF switch switching between the two passive loads for adjusting the main antenna operating in different frequency bands.

4. The self-configurable resonance antenna as described in claim 3, wherein the main antenna defines a loop antenna.

5. The self-configurable resonance antenna as described in claim 3, wherein the main antenna defines a signal antenna connecting with the filter of the matching circuit, and a signal parasitic element coupling to the signal antenna.

6. The self-configurable resonance antenna as described in claim 3, wherein the main antenna defines a loop antenna and a signal parasitic element coupling to the loop antenna.

* * * * *